US006763649B1

(12) United States Patent
Sting et al.

(10) Patent No.: US 6,763,649 B1
(45) Date of Patent: Jul. 20, 2004

(54) DEVICE FOR HANDLING OBJECTS IN SHEET FORM

(75) Inventors: Martin Sting, Bad Vilbel (DE); Christian Botschek, Rodermark (DE)

(73) Assignee: Pitney Bowes Deutschland GmbH (DE)

( * ) Notice: Subject to any disclaimer, the term of this patent is extended or adjusted under 35 U.S.C. 154(b) by 0 days.

(21) Appl. No.: 09/700,528

(22) PCT Filed: Mar. 24, 2000

(86) PCT No.: PCT/EP00/02638

§ 371 (c)(1),
(2), (4) Date: Nov. 15, 2000

(87) PCT Pub. No.: WO00/58114

PCT Pub. Date: Oct. 5, 2000

(30) Foreign Application Priority Data

Mar. 25, 1999 (DE) ..... 199 13 639

(51) Int. Cl.[7] ..... B65B 43/26
(52) U.S. Cl. ..... 53/569; 192/125 B; 74/42
(58) Field of Search ..... 53/284.3, 569, 53/460, 252, 381.5, 228, 229, 230; 192/125 R, 126, 125 B; 74/42, 43, 44, 45, 46, 47

(56) References Cited

U.S. PATENT DOCUMENTS 1,819,673 A * 8/1931 Cameron ..... 192/126
3,077,966 A * 2/1963 Cohn ..... 192/125 B
4,079,576 A * 3/1978 Morrison et al. ..... 53/284.3
4,720,960 A * 1/1988 Green ..... 270/58.06
5,548,863 A * 8/1996 Deng ..... 15/250.16
6,164,046 A * 12/2000 Werner et al. ..... 53/569
6,289,658 B1 * 9/2001 Sting et al. ..... 53/252

FOREIGN PATENT DOCUMENTS

| | | |
|---|---|---|
| DE | 1010869 | 12/1957 |
| WO | WO92/20532 | 11/1992 |
| WO | WO99/01295 | 1/1999 |

* cited by examiner

*Primary Examiner*—Rinaldi I. Rada
*Assistant Examiner*—John Paradiso
(74) *Attorney, Agent, or Firm*—Michael J. Cummings; Charles R. Malandra, Jr.; Angelo N. Chaclas

(57) ABSTRACT

In an apparatus for handling sheet-like articles, in particular an envelope-filling station, an overload-prevention means is incorporated in the connection between a drive mechanism and an actuating arrangement for push-in fingers, which are guided over a base plate, in that the drive mechanism has a crankshaft, a crank and a connecting rod, which is routed from said crank to an auxiliary drive lever, in that the auxiliary drive lever is mounted on the same shaft as a drive lever of the actuating arrangement, coaxially with respect to said drive lever and such that it can be pivoted relative to the same, and in that spring means clamp the auxiliary drive lever and the drive lever together on a pivot stop, which is provided between said levers, such that the levers cannot separate during the operating stroke.

1 Claim, 2 Drawing Sheets

DEVICE FOR HANDLING OBJECTS IN SHEET FORM

TECHNICAL FIELD

Figure 1:
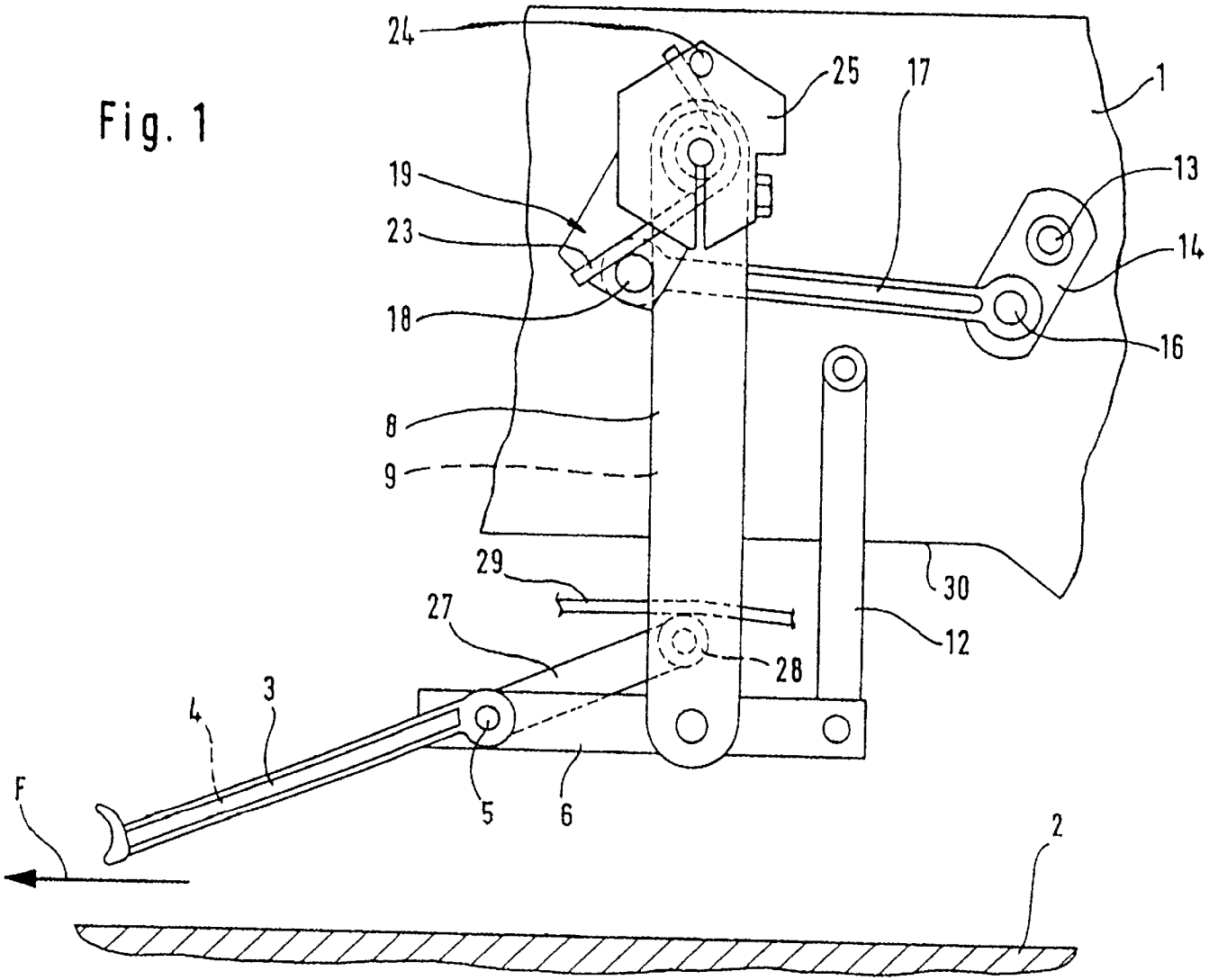

The invention relates to an arrangement for handling sheet-like articles, in particular an envelope-filling station in mail-processing machines, according to the preamble of claim 1.

BACKGROUND ART

Known envelope-filling stations of the type under consideration here contain an actuating arrangement, which has at least one drive lever which is mounted pivotably on the framework at its top end and of which the bottom end is in connection with handling elements which can be moved backward and forward in a conveying direction over a horizontal base plate, and also contain a drive mechanism, which drives the at least one drive lever in a forward pivoting movement for carrying out an operating stroke, and in a backward pivoting movement for carrying out a return stroke, of the handling elements.

WO 99/01295 A1 discloses an arrangement for handling sheet-like articles which has the features of the preamble of patent claim 1. In this known arrangement, the drive-lever arrangement is in the form of a three-lever rectilinear-guidance mechanism. One of the levers which forms part of said three-lever rectilinear-guidance mechanism, is in connection with the handling elements at its bottom end, and is mounted pivotably on the framework at its top end, is connected integrally to an auxiliary drive lever which projects away at an angle from a main part of said lever and is connected to a connecting rod, which is coupled to the crank and the crankshaft of the drive mechanism.

In the case of an increase in the operating speed of the arrangement, in the case of unexpected changes in the properties and behavior of the articles which are to handled, and in the case of operational disruptions and the like caused by the ingress of foreign bodies, it may be that, during the operating stroke, the push-in fingers cannot complete their route over the base plate and catch on the base plate or on cutouts thereof, or on the articles which are to be conveyed, and that this damages the actuating arrangement and/or its drive mechanism. Damage to the actuating arrangement on account of blocking of the push-in fingers during the operating stroke thereof is all the more probable the finer the members of said actuating arrangement are, for the purpose of reducing the moving masses at elevated operating speeds and, for example, of reducing the overall height.

DISCLOSURE OF THE INVENTION

The invention is intended to achieve the object of configuring an arrangement for handling sheet-like articles of the general type described in the introduction so as reliably to avoid, in all phases of the operating stroke, an overloading of parts of the apparatus in the case of blocking of the handling elements during said operating stroke.

This object is achieved according to the invention by the features specified in claim 1.

Advantageous configurations and developments are defined in the claims following claim 1 and, without the wording thereof being repeated here, the contents of these claims hereby expressly form a constituent part of the description.

DETAILED DESCRIPTION OF THE INVENTION

Figure 2:
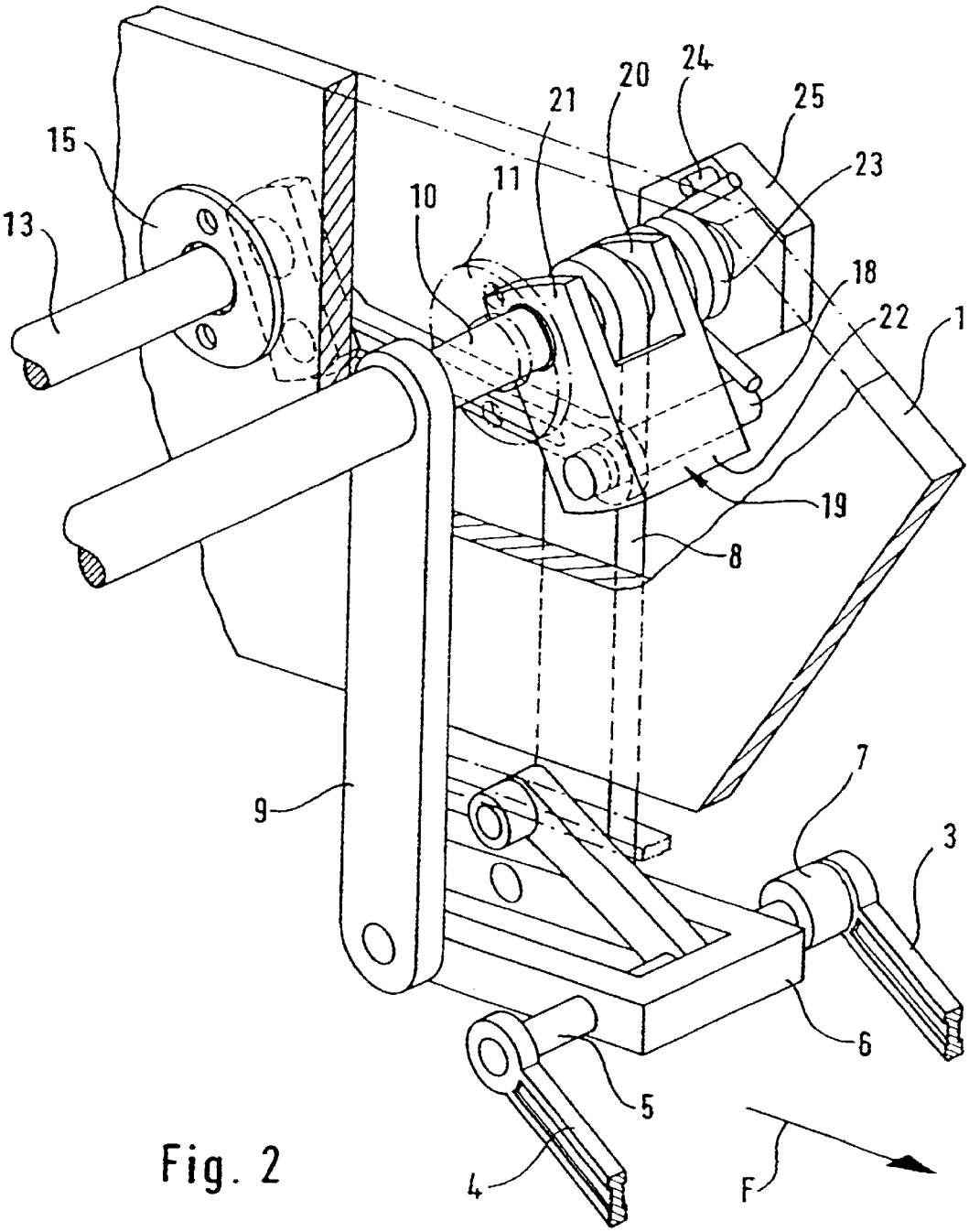

An embodiment is explained in more detail hereinbelow with reference to the drawing, in which:

FIG. 1 illustrates, partially in section and partially in a schematic depiction, a side view of part of a handling arrangement of the type specified here, and FIG. 2 illustrates a schematic view of some of the parts of the arrangement according to FIG. 1, in a perspective illustration.

The handling arrangement or envelope-filling station according to FIG. 1 contains a housing, which, for the sake of simplification of the illustration, is not shown in the drawing, with housing side parts and a housing roof. A housing intermediate wall 1 in the form of a comparatively thick metal panel is installed in said housing. The housing intermediate wall 1 determines a vertical plane which is parallel to the direction of the operating stroke, corresponding to the arrow F. The bottom border of the housing intermediate wall is located at a certain distance above a base plate 2, onto which sheet-like articles which are to be handled, sets of enclosures which are to be inserted in envelopes, and the like are fed by suitable means, for example conveying chains operated intermittently or cyclically, in order then to be pushed into an open envelope by two or more push-in fingers 3, 4 or to be transported further to further processing means. The push-in fingers 3 and 4 are fastened on a push-in-finger shaft 5 which, for its part, is mounted rotatably at the front end of a carrier hand 6, it being the case that prestressing spring means 7 supported on the carrier hand 6, on the one hand, and on an abutment of the push-in-finger shaft 5, on the other hand, prestress the push-in fingers 3 and 4 in relation to the position indicated in FIG. 1 such that the outer free ends of the push-in fingers tend to rest on the base plate 2 and to slide over the base plate 2 in the operating stroke.

The carrier hand 6 is of U-shaped formation and has two U-legs which are of different lengths and on which drive levers 8 and 9 of a drive-lever pair are articulated in the central region of the carrier hand 6. The top ends of the drive levers 8 and 9 are connected in a rotationally fixed manner to a pivot spindle 10 which, on the one hand, is mounted on a bearing 11, supported by the housing intermediate wall 1, and also has an additional bearing in a housing side wall, which is spaced apart from the housing intermediate wall 1. This further bearing is not shown in the drawing. The longer of the two U-legs of the carrier hand 6 has at its rear end, which can be seen in the illustration of FIG. 1 but not in the illustration of FIG. 2, the point of articulation for a link 12, of which the top end is mounted pivotably likewise on the housing intermediate wall 1.

The drive levers 8 and 9, the carrier hand 6 and the link 12 form, on account of the arrangement of their pivot mountings on the housing intermediate wall 1 and of the points of articulation between the levers 8, 9, the link 12 and the carrier hand 6, and on account of the corresponding length of the distances between the bearing points, a three-lever rectilinear-guidance mechanism which, when the drive levers 8, 9 pivot, causes the push-in-finger shaft 5 to be moved, during the operating stroke and the return stroke, approximately parallel to itself in a horizontal plane which is located at a certain distance above the horizontal base plate 2.

In the case of an arrangement of the type specified here, for the purpose of carrying out the forward pivoting movement and the backward pivoting movement of the drive levers 8, 9, a drive mechanism acts on the drive levers not directly but via an overload-prevention means.

The drive mechanism contains a crankshaft 13, at one end of which a crank 14 is fastened. The crankshaft 13 is mounted in the housing side wall, spaced apart from the housing intermediate wall 1, by a bearing 15, which is supported by the housing intermediate wall 1, and by a further bearing. On that side of the crankshaft 13 which is remote from the crank 14, said crankshaft is coupled to a drive motor, which makes the crankshaft 13 rotate. Mounted on the journal 16 of the crank 14 is a connecting rod 17, of which the end remote from the journal 16 acts on an auxiliary drive lever 19 via a stop and bearing pin 18. The auxiliary drive lever 19 is mounted rotatably on the pivot spindle 10, connected fixedly to the drive levers 8 and 9, to be precise it is mounted rotatably on that section of the pivot spindle 10 which projects out beyond the bearing 11 in the housing intermediate wall 1 and has the fastening location for the drive lever 8.

In specific terms, the auxiliary drive lever 19 contains side members 20 and 21, which are located on both sides of the drive lever 8 and have rotary bearings which interact with the pivot spindle 10, and also contains a web 22, which connects the two side members 20, 21. The distance between the side members 20 and 21 is such that the drive lever 8 and the front end of the connecting rod 17, said front end being adjacent to the drive lever 8, are accommodated, in the direction of the pivot spindle 10, in the interspace between the side members 20 and 21.

While one end of the stop and bearing bolt 18 terminates flush with the outside of the side member 21, the stop and bearing bolt 18 on the side of the side member 20 of the auxiliary drive lever 19 projects beyond said side member 20 and serves here as a spring stop for a helical prestressing spring 23, which wraps around a projecting section of the pivot spindle 10 and of which the other spring end is supported on a stop bolt 24 of a spring bearing 25, said stop bolt projecting parallel to the pivot spindle 10. The spring bearing 25 is positioned on the outer end of the pivot spindle 10 and clamped firmly there. It is possible to change the rotary position of the spring bearing 25 with respect to the pivot spindle 10 in order to change the relative angle positions between the stop and bearing bolt 18 and the bolt 24 of the spring bearing 25, with the result that it is possible to adjust the prestressing force exerted on the auxiliary drive lever 19 by the helical prestressing spring 23. It can be seen that the helical prestressing spring 23 prestresses the auxiliary drive lever 19 in the anticlockwise direction, in relation to the illustration of FIG. 1, relative to the pivot spindle 10 and thus relative to the drive lever 8 fastened thereon, such that the stop and bearing bolt 18 is always pressed against that narrow side of the drive lever 8 which is located on the left in FIG. 1.

If however, during the operating stroke of the actuating arrangement, the push-in arms 3, 4 are obstructed on their route in the direction of the arrow F such that the drive levers 8, 9 cannot continue to pivot in the operating stroke, then the stop and bearing bolt 18, and thus the auxiliary drive lever 19, are raised from the narrow side of the drive lever 8 as soon as the drive force transmitted by the crank 14 overcomes the opposing force produced by the helical prestressing spring 23. The crank 14 can thus complete its circulatory movement without, in the case of an obstruction of the actuating arrangement, parts of the latter or parts of the drive being destroyed.

It is of note that the response behavior of the overload-prevention means, which is formed by the helical prestressing spring 23, by the spring bearings assigned to it and by the auxiliary drive lever 19, does not depend on a certain position of the drive mechanism and, in particular, of the crank 14 in the various positions of its circulatory movement. The overload-prevention means proposed here thus has essentially the same response behavior for the dead-center positions of the crank 14 and those positions of the latter which are offset by 90 degrees with respect to the dead-center position.

A further advantage of the embodiment described and shown here is that the point at which the connecting rod 17 acts on the actuating mechanism which contains the carrier hand 6 and is intended for selecting certain movement characteristics of the front ends of the push-in fingers 3, 4 during the circulatory movement of the crank need not be positioned on side extensions of the drive lever 8 or drive levers, outside the rectilinear connection between the top and bottom lever ends, but rather may be provided on the auxiliary drive lever 19, so as to provide a straightforward, rectilinear form of the drive lever 8 and thus the possibility of producing said drive lever 8 from inexpensive semifinished material.

It should also be mentioned that the actuation of the push-in fingers 3, 4 with the effect of lowering the latter onto the base plate 2, for the operating stroke in the direction of the arrow F, and with the effect of raising the push-in fingers 3, 4 from the base plate 2, for the return stroke, is carried out by a guide control means which is merely schematically indicated in FIGS. 1 and 2. The guide control means contains a guide contact lever 27, connected fixedly to the push-in-finger shaft 5, a guide contact roller 28, mounted at the free end of said guide contact lever, a guide path 29, interacting with the guide contact roller 28, and a further guide path 30, in the form of the bottom border of the housing intermediate wall 1. Details of the guide control means are not important for the operation of the specified overload-prevention means between the drive mechanism and the actuating arrangement of the present handling apparatus. All that need be said here is that the guide contact roller 28 follows the guide path 30 during the operating stroke of the actuating arrangement, the outer ends of the push-in fingers 3, 4 being lowered onto the base plate 2, and that the guide contact roller 28 follows the guide path 29 in the return stroke of the actuating arrangement, the ends of the push-in fingers 3, 4 being raised from the base plate 2, counter to the prestressing by the helical prestressing spring 7.

What is claimed is:

1. An arrangement for handling sheet-like articles, in particular for an envelope-filling station in mail-processing machine, having handling elements (3, 4) which can be moved forward in an operating stroke, and backward in a return stroke, over a horizontal base plate (2) and are intended for conveying the articles over the base plate (2) in their operating stroke, an actuating arrangement which has a drive-lever arrangement (8/9) with a drive lever (8), which is mounted on a shaft (10) at its top end, and with an auxiliary drive lever (19), which is likewise mounted on the shaft (10), the bottom end of the drive lever (8) being in connection with the handling elements (3,4), a drive mechanism (13, 14, 16, 17) with a crankshaft (13), a crank (14), and a connecting rod (17), which is routed from said crank to the auxiliary drive lever (19), characterized in that the auxiliary drive lever (19) is mounted on the shaft (10) coaxially with respect to the drive lever (8) and such that it can be pivoted relative to the drive lever (8), in that the auxiliary drive lever (19) and the drive lever (8) are clamped together by spring means (23, 24, 25) on a pivot stop (18), which is arranged between them and can be moved together with them, to prevent separation from one another during the operating stroke, such that, in the case of forced blocking of the handling elements (3, 4), during the operating stroke, the auxiliary drive lever (19) can be moved separately from the drive lever (8), overcoming the clamping-together action in the process, in that the drive lever (8) is mounted in a rotationally fixed manner on the shaft (10), in that the spring means (23, 24, 25) contain a helical spring (23) which wraps around the shaft (10) and is supported, on the one hand, against a spring bearing (25), fastened on the shaft (10), in particular in an adjustable manner, and, on the other hand, against the pivot stop (18), which is designed, in particular, as a bolt which projects from the auxiliary drive lever (19) parallel to the shaft (10), in that the auxiliary drive lever (19) has side members (20, 21) and a connecting web (22) which connects the same, the side members (20, 21) being mounted on the shaft (10), coaxially with the drive lever (8) on both sides, and in that a bolt running between the side members (29, 21) mounts that end of the connecting rod (17) which is remote from the crank (14) and also forms the pivot stop (18).

* * * * *